United States Patent [19]

Chantry et al.

[11] 4,003,974

[45] Jan. 18, 1977

[54] CONTINUOUS SPIN-DRAWING PROCESS FOR PREPARING POLYETHYLENE TEREPHTHALATE YARNS

[75] Inventors: William Amdor Chantry, Kinston, N.C.; Roddy Merl Conrad, Hamm, Germany

[73] Assignee: E. I. Du Pont de Nemours and Company, Wilmington, Del.

[22] Filed: Apr. 4, 1975

[21] Appl. No.: 565,079

[52] U.S. Cl. ..... 264/210 F; 264/290 T; 264/342 RE

[51] Int. Cl.[2] ..... D01D 5/08

[58] Field of Search ..... 264/168, 210 F, 342 RE, 264/290 T

[56] References Cited

UNITED STATES PATENTS

| | | | |
|---|---|---|---|
| 3,069,836 | 12/1962 | Dahlstrom et al. | 97/157 |
| 3,216,187 | 11/1965 | Chantry et al. | 97/140 |
| 3,413,797 | 12/1968 | Chapman | 97/140 |
| 3,452,132 | 6/1969 | Pitzl | 264/290 T |
| 3,562,382 | 2/1971 | Fowler | 264/290 T |
| 3,650,879 | 3/1972 | Munting | 161/189 |
| 3,690,362 | 9/1972 | Mago et al. | 152/359 |
| 3,715,421 | 2/1973 | Martin et al. | 264/130 |

FOREIGN PATENTS OR APPLICATIONS

| | | | |
|---|---|---|---|
| 1,063,013 | 3/1967 | United Kingdom | 264/210 F |
| 1,224,038 | 3/1971 | United Kingdom | 264/210 F |
| 1,266,982 | 3/1972 | United Kingdom | 264/210 F |

*Primary Examiner*—Jay H. Woo

[57] ABSTRACT

A process is provided in which a continuous filament polyethylene terephthalate yarn having an HRV in the range of 24 to 28 is heated to a temperature in the range of 75° to 250° C. and drawn to a total denier in the range of 50 to 500 at a draw ratio in the range of 5.2:1 to 6:1, passed over a draw roll having a temperature in the range of 225° to 250° C., relaxed at a tension in the range of 0.09 to 0.15 gram per denier and wound up at a minimum speed of 2,000 yards per minute (1829 meters/minute). The yarns prepared by this process have a tenacity in the range of 7.5 to 9 grams per denier, a load-bearing capacity in the range of 3 to 5 grams per denier at 7% elongation, a maximum dry heat shrinkage of 4% at 177° C. and an elongation at break in the range of 12 to 20%.

5 Claims, No Drawings

CONTINUOUS SPIN-DRAWING PROCESS FOR PREPARING POLYETHYLENE TEREPHTHALATE YARNS

This invention relates to a high speed process for preparing polyethylene terephthalate yarns having a unique combination of properties which makes them eminently suitable for use as sewing threads or for the production of industrial fabrics and other like uses.

Heretofore, polyethylene terephthalate yarns to be used primarily as described above were carefully prepared using low speed processes in order to obtain the proper balance of properties such as modulus, tenacity, shrinkage, denier, strength and the like. Generally, commercially employed methods of manufacture have involved windup speeds of less than about 1,100 meters per minute. In other processes in which higher windup speeds have been used, it has not been possible to obtain optimum properties in the correct balance in the final product.

It has now been found that polyethylene terephthalate yarn can be made with the correct balance of optimum properties at windup speeds of 2,000 yards per minute (1829 meters/minute) or higher by heating an undrawn polyethylene terephthalate yarn having an HRV in the range of 24 to 28 to a temperature in the range of 75° to 250° C. and drawing it to a total denier in the range of 50 to 500 at a draw ratio in the range of 5.2:1 to 6:1, passing the drawn yarn over a draw roll or rolls heated at a temperature in the range of 225° to 250° C., relaxing the yarn at a tension in the range of 0.09 to 0.15 gram per denier to achieve a degree of relaxation of up to a maximum of 6.2% of the drawn length and then winding up the yarn in the normal manner but at a minimum speed of 2,000 yards per minute, preferably at windup speeds of from 2,000 to 3,500 yards per minute (3200 meters/minute) inclusive.

The continuous filament poly(ethylene terephthalate) yarns produced by the process of this invention have a tenacity in the range of 7.5 to 9.0 grams per denier, preferably 7.5 to 8.0; a load-bearing capacity at 7% elongation in the range of 3 to 5, preferably 3 to 4 grams per denier; a break elongation in the range of 12 to 20%, preferably 14 to 17% and a dry heat shrinkage (DHS) of 4% or less measured at 177° C. The yarns of this invention are useful as sewing threads and industrial yarns and those which fall within the preferred limits are eminently suitable for use as sewing threads which are to be used at high stitch speeds, as well as for many other uses which require a light denier industrial yarn. In any case, the yarns produced by the process of this invention may be employed without the need for further hot stretching by the manufacturer.

The process of this invention can be coupled with filament extrusion; that is, the freshly extruded polymer can be heated, drawn, passed over a heated draw roll or rolls, relaxed and then wound up at speeds of 2,000 yards or more per minute in a coupled operation. This embodiment is preferred since it requires a minimum of equipment to achieve a maximum output of consistently high quality product. Alternatively, undrawn filaments may be made and wound up and subsequently subjected to the process of this invention in a so-called "split process". In either case, advantageous products are produced by the invention at high speeds.

The yarns of this invention are prepared from a poly(ethylene terephthalate) polymer containing no more than small amounts of other ester-forming components; i.e., they are composed of polymer made up of at least 95%, preferably at least 97% of ethylene terephthalate repeating units of the formula:

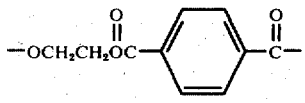

Accordingly, the term "polyethylene terephthalate" as used herein is understood to refer to polymers containing up to about 5 mol percent and preferably less than 3 mol percent of other ester-forming units. Other ester-forming units which may be present in these minor amounts include diethylene glycol, other polymethylene glycols having 1 to 10 carbon atoms, hexahydro-p-xylylene glycol, other aromatic dicarboxylic acids such as isophthalic acid, bibenzoic acid, and p-terphenyl-4,4''-dicarboxylic acid, cycloaliphatic acids such as hexahydroterephthalic acid, or small amounts of aliphatic acids, such as adipic acid, or a hydroxy acid such as hydroxyacetic acid.

In order to prepare light weight, continuous filament polyester yarns having a combination of high strength, high modulus and low shrinkage in accordance with this invention at windup speeds of 2,000 yards per minute and higher, it is critical that the HRV of the filaments which are melt spun is in the range of 24 – 28 inclusive. If the molecular weight of the polymer is such that the HRV of the yarn is less than about 24, the required tensile properties cannot be obtained at such high speeds. If the molecular weight of the polymer is such that the HRV is greater than about 28, low percent shrinkage values in combination with the other advantageous properties of the yarns of this invention cannot be achieved at such high speeds.

In order to draw the yarn to the necessary tenacity for the yarns of this invention, the yarns must be drawn while heated to a temperature in the range of 75° to 250° C. Any suitable means may be employed to raise the temperature of the yarn into the specified range, but, for ease of operation, steam at a temperature in the range of 275° to 360° C. and a pressure in the range of 30 to 150 psig is employed in a jet enclosure as disclosed, for example, in U.S. Pat. No. 3,452,132 issued June 24, 1969 to Pitzl. Other expedients which may be employed include hot rolls, a two-step liquid bath process, heated plates and the like as disclosed, for example, in U.S. Pat. Nos. 2,556,295 issued June 12, 1951 to Pace; 2,611,923 and 2,533,013 issued Sept. 30, 1952 and Dec. 5, 1950, respectively, to Hume and the like.

When a polyethylene terephthalate yarn having an HRV in the range of 24 to 28 is heated to a temperature in the range of 75° to 250° C., it is heated sufficiently to be drawn to a total denier in the range of 50 to 500 at a ratio in the range of 5.2:1 to 6:1 at the high speeds of the process. By thus drawing the yarn and then passing it over a draw roll or rolls heated in the range of 225° to 250° C., controlled crystallization is induced and the orientation which is responsible for the high tenacity and modulus is thermally set or locked in.

By allowing controlled relaxation of the drawn yarn up to a maximum of 6.2% of the drawn length at a tension off the draw roll in the range of 0.09 to 0.15 grams per denier, a critical balance is maintained. On one hand, internal stresses are removed which in turn reduces dry heat shrinkage to the levels specified herein; on the other hand, that degree of relaxation which causes a marked reduction in the modulus is avoided.

The residence time of the yarn on the draw roll or rolls is controlled by the speed of the process. Generally, the yarn will be in contact with the draw rolls for from 0.04 second to a minute depending on the number of wraps taken around the draw rolls. Since the present process is advantageous because of its high speed, the draw roll contact time will preferably be in the range of 0.07 to 0.2 second. This is in marked contrast to prior processes which require heating times of several minutes in order to achieve low shrinkage.

Although the yarn can be wound up directly from the hot draw rolls, it has been found to be most advantageous to pass the yarn around a let down roll or rolls after it leaves the draw rolls and before windup. The let down roll or rolls may be heated if desired although let down rolls to which no heat is applied are used in a preferred embodiment of the invention. If the let down rolls heat to a temperature of about 80° C. or higher, the percent shrinkage of the yarn tends to increase.

Any suitable windup apparatus which can be operated at speeds of 2,000 yards per minute and higher may be employed in the practice of this invention. Some such suitable apparatuses are disclosed, for example, in U.S. Pat. Nos. 3,092,339 issued June 4, 1963 to Hill and Vanneman; 3,452,132 issued June 24, 1969 to Pitzl and the like.

A finish may be applied to the yarns of this invention before, during and/or after being processed in accordance with this invention. Any desired finish may be used including yarn coatings of a suitable textile-treating agent or a combination of agents such as mineral, vegetable, and animal oils, as for example, a light mineral oil, olive oil, coconut oil and sperm oil, a process oil such as sulfonated and sulfated esters and their salts, a synthetic material such as a silicone oil, diethylene glycol, a mono-, di-, or triester such as is prepared from a 12- to 18-carbon monocarboxylic acid, e.g., stearic, and a 2- to 16-carbon mono- or polyhydric alcohol, for example, sorbitan, glycerol, glycol and the like. The finish may also be a soap such as an alkanolamine or alkali metal salt of a fatty acid, a wax, a biocide or an antistat such as a condensate of from 3 to 20 mols of ethylene or other alkylene oxide with one mol of a compound with an active H atom, for example, a fatty acid or fatty alcohol containing from 4 to 20 carbon atoms or a salt of an alkyl or oxyalkylene phosphate. The textile-treating agents are preferably combined with an organic liquid diluent, such as a hydrocarbon, a halogenated hydrocarbon, an alcohol, an ester or a ketone or an ether, preferably with a high-boiling liquid such as kerosene. If desired, these agents may be emulsified in water in accordance with principles known to the art. The lubricating finish will usually have a concentration of about 5–30% "solids" so as to deposit from about 0.05 to 2.5% solids on the yarn.

In a preferred embodiment of this invention, the filaments, after leaving the spinneret, are passed first through a 5 – 10 inch long heated zone having a metal wall temperature of 250°–350° C. The filaments are then quenched by blowing air at room temperature (about 25° C.) across the filament bundle. This controlled retarded cooling process yields a more uniform product which provides better performance while drawing. A similar process which may be used is disclosed in U.S. Pat. No. 3,361,859 issued on Jan. 2, 1968 to Cenzato.

DEFINITIONS AND MEASUREMENTS

Yarn tenacity and break elongation are determined by means of an Instron Tensile Tester which extends a 10-inch (25.4 cm.) length yarn sample to its breaking point at an extension rate of 6 in./min. (15.2cm./min.) at a temperature of about 25° C. Extension and breaking load are automatically recorded for each sample $T_7$, a measure of yarn modulus, is the load-bearing capacity in g./den., of the yarn at 7% elongation. $T_7$ may be obtained from the stress-strain curve produced by the Instron Tensile Tester in measuring tenacity and break elongation, as above.

Dry-heat shrinkage at 177° C. ($DHS_{177}$) is determined by exposing a measured length of yarn under zero tension to dry heat for 30 min. in an oven maintained at 177° C. and measuring the amount of retraction. The amount of shrinkage is expressed as a percentage of the original length.

HRV is a sensitive and precise measurement indicative of polymer molecular weight. HRV is the ratio of the viscosity of a solution of 0.8 gram of polymer dissolved at 49° C. in 10 ml. of hexafluoroisopropanol containing 80 ppm $H_2SO_4$ to the viscosity of the $H_2SO_4$-containing hexafluoroisopropanol itself, both measured at 25° C. in a capillary viscometer and expressed in the same units. The use of hexafluoroisopropanol as solvent is important in that it allows dissolution at the specified temperature and thereby avoids the polymer degradation normally encountered when polyesters are dissolved at elevated temperatures. HRV values of 24 and 28 correspond roughly to intrinsic viscosity values of 0.68 and 0.74, respectively, when the intrinsic viscosity is measured at 25° C. in a solvent composed of a mixture of trifluoroacetic acid and methylene chloride (25/75 by volume).

The tension on the yarn leaving the hot draw rolls may be measured by means of a Check Line Master Series Tensiometer obtainable from the Electromatic Equipment Company of Cedarhurst, N.Y.

The invention is further illustrated but is not intended to be limited by the following examples in which all parts and percentages are by weight unless otherwise specified.

EXAMPLE I

This example illustrates the preparation of a 210 denier polyester industrial yarn at a draw roll speed of 3500 ypm.

Polyethylene terephthalate is melt spun through a 50-hole spinneret using a spinning block temperature of 285° C. to give a yarn product having an HRV of 27. Immediately below the spinneret, the extruded filaments pass through a heated-wall delay baffle having a length of 7½ inches and having a wall temperature maintained at 300°–325° C. Below the delay baffle the filaments pass through a quench zone where the filaments are quenched in cross-flow air at room temperature. The quenched filaments pass around unheated feed rolls operating at 625 ypm (571 meters/min.), then through a draw jet supplied with steam at about 60 psig (5.08 atm.) at a temperature of 275°–300° C. The yarn is then wound (7½ wraps) around a pair of draw rolls having a surface temperature of 245°–248° C. and operating at 3500 ypm (3200 meters/min.) for a residence time of 0.09 second on the draw rolls. The draw ratio is 5.6:1; the total drawn denier is 210. The drawn yarn then passes to and around a pair of unheated let down rolls operated at 3318 ypm (3034 meters/min.) which allows 5.2% retraction in length at a tension of 0.12 g./den. From the let down rolls the yarn passes to a conventional surface driven package windup at a drive roll speed of 3300 ypm (3011 meters/minute).

Conventional oil-in-water emulsion finishes are applied to the yarn at three points in the above process to provide lubrication and antistatic protection. A coconut-oil-based finish is applied just below the quench zone and between the draw jet and the draw rolls; a butyl-stearate-based finish is applied between the let-down rolls and the windup for a total finish on yarn of 0.57%. The yarn is also interlaced after the second of two let down rolls to provide bundle coherency, using an interlacing jet in the manner described by Bunting & Nelson in U.S. Pat. No. 3,110,151.

The 27 HRV yarn produced has a tenacity of 7.6 g./den., a break elongation of 16.0%, a $T_7$ value of 3.2 gpd and a dry-heat shrinkage at 177° C. of 3.5%. The process operates efficiently without deleteriously affecting the advantageous properties of the yarn.

EXAMPLE II

This example illustrates the preparation of a 220 denier polyester industrial yarn at a draw roll speed of 2500 ypm.

Following the general procedure of Example I, polyethylene terephthalate is melt spun, drawn, and wound up on a bobbin to give a yarn having a HRV of 25.2. The delay baffle used has a length of 7½ inches (19.1 cm.) and a wall temperature of 300° C. The feed roll is operated at a speed of 424 yards/minute (388 meters/-minute) and the draw jet is supplied with steam at 300° C. and 40 psig (3.72 atm.). The draw roll, let down and windup speeds are given in the Table. The hot draw rolls are operated at 2500 yards/minute (2286 meters/-minute) with a surface temperature of 235° C. allowing a residence time of 0.125 second for the yarn on the draw roll. The draw ratio is 5.9:1; the total drawn denier is 225. The tension on the yarn between the draw rolls and the let down rolls is maintained at 0.11 gpd which allows 6.0% retraction in length.

The yarn contains 0.7% finish.

The 25.2 HRV yarn produced has a tenacity of 7.6 gpd, a break elongation of 16.2%, a $T_7$ of 3.2 gpd and a $DHS_{177°}$ of 4%. The yarn is considered suitable for processing into a sewing thread without further heat stabilization treatments.

EXAMPLE III

This example illustrates a high-speed process for the preparation of 70 denier polyester industrial yarn.

Following the general procedure of Example I except that a 34-hole spinneret is used, polyethylene terephthalate is melt spun and drawn using a draw speed of 2500 ypm (2286 meters/minute) to give a yarn product having an HRV of 26.2. In this example the heated delay baffle is 7½ inches (19.1 cm.) long and its temperature control is set at 300° C. The draw jet is supplied with steam at 300° C. and 45 psig (4.06 atm.), and the feed roll speed is set to give a draw ratio of 5.7:1 and a total drawn denier of 72. The draw roll, let down and windup speeds are given in the Table. Draw roll temperature is 240° C. and the yarn has a residence time of 0.125 second on the draw roll. Yarn tension between draw rolls and let down rolls is maintained at 0.11 gpd which allows about 6.2% relaxation.

The 34 filament, 26.2 HRV yarn produced has a tenacity of 7.7 gpd, a break elongation of 16.6%, a $T_7$ of 3.2 gpd and a $DHS_{177°}$ of 3.5%. The yarn is considered suitable for use as sewing thread without further stabilization treatments.

EXAMPLE IV

For comparative purposes the procedure of Example I is used employing a higher molecular weight polyethylene terephthalate polymer to produce a yarn having an HRV value of 32. The combination of high modulus and low shrinkage produced in Example I could not be obtained using this high molecular weight polymer. The best combination of yarn properties that could be obtained at reasonably high speeds from the higher molecular weight polymer was achieved by adjusting the spinning-block temperature to 295° C. and the heated delay baffle temperature to 450°–460° C. The filaments are then quenched in quiescent (20° – 25° C.) room temperature air (no cross-flow air) and drawn in a draw jet supplied with steam at 370° C., 30 psig. (3.04 atm.). The draw ratio is 6.33:1. The yarn is drawn to a total drawn denier of 220 in two stages with a first stage draw roll temperature of 155° C. and roll speed of 1957 ypm, allowing a residence time for the yarn on the draw roll of 0.16 second and a second stage draw roll temperature of 225° C. and roll speed of 2000 ypm, allowing a residence time for the yarn on the draw roll of 0.157 second. Let down and windup speeds are given in the Table. The yarn is allowed to retract 6% in length between the second stage draw roll and a pair of unheated let down rolls and is further allowed to relax 1.1% between the let down rolls and the windup. In this procedure, the finishes applied to the yarn below the quench zone and below the draw rolls are similar to those used in Example I. The finish applied just prior to the draw rolls contains an end-capped polyoxyalkylene oil as the major component of the oil phase. The yarn produced was found to have a tenacity of 8.6 gpd, a break elongation of 16%, a $T_7$ value of 3.4 gpd and a dry heat shrinkage at 177° C. of 6.0%. The high shrinkage value of this yarn which made it unacceptable for the intended purpose was obtained in spite of the involved process employed to reduce the shrinkage as much as possible.

EXAMPLE V

For comparative purposes, the procedure of Example I is used employing a polyethylene terephthalate polymer having a molecular weight which gives filaments having an HRV of 23. No combination of high speed process conditions could be used to produce yarns having the desired properties of Example I from the low molecular weight polymer. At the draw roll, let down and windup speeds given in the Table, using a draw roll temperature of 235° C., at 7½ wraps, the yarn has a draw roll residence time of 0.09 second and experiences a 5% retraction in length between draw rolls and let down rolls at a tension level of 0.114 gpd. The draw ratio is 5.0; the total drawn denier is 221. The yarn produced has a tenacity of 7.2 gpd, a break elongation of 16%, a $T_7$ of 3.6 gpd and a dry heat shrinkage at 177° C. of 4.2%. Both strength and shrinkage are outside of the limits of this invention.

TABLE

| Example | [I]II | [II]III | [III]IV | [IV]V |
|---|---|---|---|---|
| Speed of yarn on draw (ypm) | 2501 | 2500 | — | 3501 |
| Speed of let down rolls (ypm) | 2350 | 2343 | 1879 | 3325 |
| Windup drive roll speed (ypm) | 2397 | 2378 | 1881 | 3403 |

EXAMPLE VI

For comparative purposes the general procedure of Example I is followed as described below but a higher molecular weight polyethylene terephthalate polymer is used to produce a yarn having an HRV value of 29.7. The combination of high modulus and low shrinkage produced in Example I could not be obtained.

Polyethylene terephthalate is melt spun through a 50-hole spinneret using a spinning block temperature of 290° C. to give a yarn product having an HRV of 29.7. Immediately below the spinneret, the extruded filaments pass through a heated wall delay baffle having a length of 7½ inches and having a wall temperature maintained at 350° C. Below the delay baffle the filaments pass through a quench zone where the filaments are quenched in cross flow air at room temperature. The quenched filaments pass around unheated feed rolls operating at 623 yd./min. (570 m./min.), then through a draw jet supplied with steam at about 60 psig (5.08 atm.) at a temperature of 275° C. The yarn is then wound (7½ wraps) around a pair of draw rolls having a surface temperature of 248° C. and operating at 3500 ypm (3200 m./min.) for a residence time of 0.09 second on the draw rolls. The draw ratio is 5.6:1; the total drawn denier is 213. The drawn yarn then passes to and around (½ wrap) an unheated first let down roll operating at a speed of 3281 ypm (3000 mpm) which allows 6.3% retraction in length at a tension of 0.07 gpd. off the draw roll. The yarn next passes through an interlace jet to and around (½ wrap) an unheated second let down roll operating at 3292 ypm (3010 mpm), and then finally to a conventional surface-driven package windup operating at a drive roll speed of 3270 ypm (2990 mpm).

Conventional finishes are applied at three points, with the total finish-on-yarn being 0.8%.

The 29.7 HRV yarn produced has a tenacity of 8.25 gpd, a break elongation of 17.2%, a $T_7$ value of 3.05 gpd and a dry heat shrinkage at 176° C. of 4.4%. The dry heat shrinkage of 4.4% is well above the 4.0% maximum allowable shrinkage of the instant invention even though a very low let down tension was used in an attempt to obtain the lowest possible shrinkage.

What is claimed is:

1. A continuous spin-drawing process for preparaing continuous filament polyethylene terephthalate yarns by a coupled process of extruding, drawing, relaxing and winding up, which comprises heating a freshly-extruded continuous filament polyethylene terephthalate yarn having an HRV of 24 to 28 to a temperature of 75° to 250° C., drawing the yarn to a total denier of 50 to 500 at a draw ratio of 5.2:1 to 6:1, passing the drawn yarn over a draw roll having a temperature of 225° to 250° C., relaxing the yarn at a tension of 0.09 to 0.15 gram per denier and winding up the yarn at a minimum speed of 2,000 yards per minute.

2. The process of claim 1 wherein the windup speed is 2,000 to 3,500 yards per minute.

3. The process of claim 1 wherein the yarn is relaxed so as to obtain a reduction in length of from 0 up to a maximum of 6.2% of the drawn length.

4. The process of claim 1 wherein the residence time of the yarn on the draw roll is at least 0.04 second.

5. The process of claim 4 wherein the residence time of the yarn on the draw roll is 0.07 to 0.2 second.

* * * * *